US006486846B1

(12) United States Patent
Hart

(10) Patent No.: US 6,486,846 B1
(45) Date of Patent: Nov. 26, 2002

(54) E H ANTENNA

(76) Inventor: Robert T. Hart, 120 Windsor Dr., Eatonton, GA (US) 30124

( * ) Notice: Subject to any disclaimer, the term of this patent is extended or adjusted under 35 U.S.C. 154(b) by 0 days.

(21) Appl. No.: 09/576,449

(22) Filed: May 23, 2000

(51) Int. Cl.[7] ..... H01Q 9/24

(52) U.S. Cl. ..... 343/773; 343/775; 343/807; 343/822; 343/859; 343/860

(58) Field of Search ..... 343/773, 774, 343/822, 852, 860, 808, 840, 859, 821, 807; H01Q 1/50, 9/24

(56) References Cited

U.S. PATENT DOCUMENTS

| | | | | | |
|---|---|---|---|---|---|
| 3,159,838 | A | * | 12/1964 | Facchine | 343/773 |
| 3,475,687 | A | | 10/1969 | Pierce | 325/305 |
| 3,521,284 | A | | 7/1970 | Shelton, Jr. et al. | 343/702 |
| 3,829,863 | A | * | 8/1974 | Lipsky | 343/773 |
| 4,003,056 | A | | 1/1977 | Davis | 343/704 |
| 4,183,027 | A | | 1/1980 | Ehrenspeck | 343/726 |
| 4,187,507 | A | | 2/1980 | Crane et al. | 343/754 |
| 4,388,625 | A | | 6/1983 | Schwartz | 343/786 |
| 4,809,009 | A | | 2/1989 | Grimes et al. | 343/726 |
| 5,155,495 | A | | 10/1992 | Hately et al. | 343/725 |
| 5,231,346 | A | | 7/1993 | Gassmann | 324/95 |
| 5,304,998 | A | | 4/1994 | Lopez | 343/767 |
| 5,495,259 | A | | 2/1996 | Lyasko | 343/788 |
| 5,534,880 | A | * | 7/1996 | Button et al. | 343/774 |
| 5,760,747 | A | | 6/1998 | McCoy et al. | 343/728 |
| 5,892,485 | A | * | 4/1999 | Glabe et al. | 343/840 |

FOREIGN PATENT DOCUMENTS

| | | |
|---|---|---|
| GB | 1284727 | 8/1972 |

* cited by examiner

*Primary Examiner*—Michael C. Wimer
(74) *Attorney, Agent, or Firm*—Bockhop & Reich, LLP

(57) ABSTRACT

In an antenna system for transmitting and receiving, in association with a radio device, electromagnetic radiation has an E-field component and an H-field component. The electromagnetic radiation corresponds to a radio frequency power signal having a current and a voltage at a radio frequency. The antenna system includes a first radiating element and a second radiating element, each comprising a conductive material. The second radiating element is spaced apart from, and in alignment with, the first radiating element. A phasing and matching network is in electrical communication with the first radiating element, the second radiating element and the radio device. The phasing and matching network aligns the relative phase between the current and the voltage of the radio frequency power signal so that the H-field component of the corresponding electromagnetic signal is nominally in time phase with the E-field component.

19 Claims, 2 Drawing Sheets

E H ANTENNA

BACKGROUND OF THE INVENTION

1. Field of the Invention

The present invention relates to radio frequency communications and, more specifically, to an antenna system employed in radio frequency communications.

2. Description of the Prior Art

Radio signals usually start with electrical signals that have been modulated onto a radio frequency carrier wave. The resulting radio signal is transmitted using an antenna. The antenna is a resonant system that generates an electrical field (E field) and a magnetic field (H field) that vary in correspondence with the radio signal, thereby forming radio frequency radiation. At a distance from the antenna, as a result of transmission effects of the medium through which the radio frequency radiation is being transmitted, the E field and the H field fall into phase with each other, thereby generating a Poynting vector, which is given by $S=E\times H$, where S is the Poynting vector, E is the E field vector and H is the H field vector.

Most conventional antenna systems are resonant systems that take the form of wire dipoles that run electrically in parallel to the output circuitry of radio frequency transmitters and receivers. Such antenna systems require that the length of the wires of the dipoles be at least one fourth of the wavelength of the radiation being transmitted or received. For example, if the wavelength of the radiation is 1000 ft., the length of the wire must be 250 ft. Thus, the typical wire antenna requires a substantial amount of space as a function of the wavelength being transmitted and received.

A crossed field antenna, as disclosed in U.S. Pat. No. 6,025,813, employs two separate sections which independently develop the E and H fields and are configured to allow combining the E and H fields to generate radio frequency radiation. The result is that the antenna is not a resonant structure, thus a single structure may be used over a wide frequency range. The crossed field antenna is small, relative to wavelength (typically 1% to 3% of wavelength) and provides high efficiency. The crossed field antenna has the disadvantage of requiring a complicated physical structure to develop the E and H fields in separate sections of the antenna.

Therefore, there is a need for a simple and compact antenna.

SUMMARY OF THE INVENTION

The disadvantages of the prior art are overcome by the present invention which, in one aspect, is an antenna system for transmitting and receiving, in association with a radio device, electromagnetic radiation having an E-field component and an H-field component. The electromagnetic radiation corresponds to a radio frequency power signal having a current and a voltage at a radio frequency. The antenna system includes a first radiating element and a second radiating element, each comprising a conductive material. The second radiating element is spaced apart from, and in alignment with, the first radiating element. A phasing and matching network is in electrical communication with the first radiating element, the second radiating element and the radio device. The phasing and matching network aligns the relative phase between the current and the voltage of the radio frequency power signal so that the H-field component of the corresponding electromagnetic signal is nominally in time phase with the E-field component.

In another aspect, the invention is a method of transmitting and receiving, in association with a radio device, electromagnetic radiation having an E-field component and an H-field component, wherein the electromagnetic radiation corresponds to a radio frequency power signal having a current and a voltage at a radio frequency. In the method, the relative phase between the current and the voltage of the radio frequency power signal is aligned so that the H-field component of the corresponding electromagnetic signal is nominally in time phase with the E-field component.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
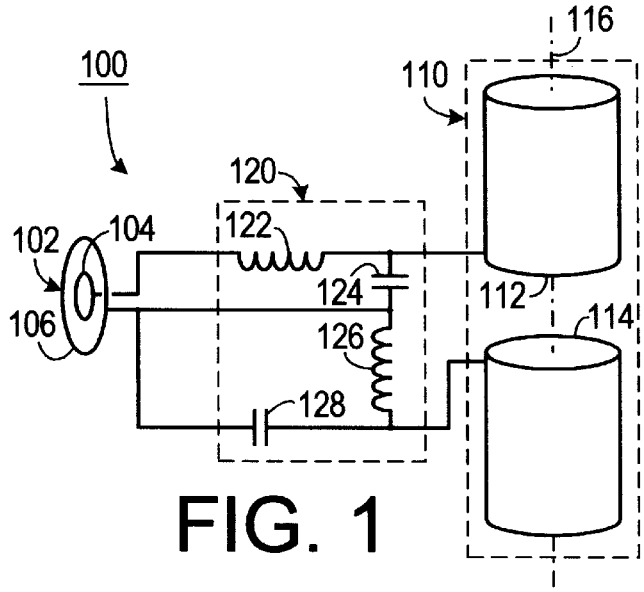
FIG. 1 is a schematic diagram of one illustrative embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." As used herein, the term "in alignment with" includes both coaxial and slightly off coaxial.

A general discussion of Poynting vector theory may be found in the disclosure of U.S. Pat. Nos. 5,155,495 and 6,025,813, which are incorporated herein by reference.

As shown in FIG. 1, one embodiment of the invention is illustrated as an antenna system 100 for transmitting and receiving, in association with a radio device 102 (such as a transmitter or a receiver), electromagnetic radiation having an E-field component and an H-field component. The electromagnetic radiation corresponds to a radio frequency power signal having a current and a voltage at a radio frequency.

The antenna system 100 includes an antenna unit 110 and a phasing/matching network 120. The antenna unit 110 includes a first radiating element 112 made of a conductive material such as a metal (for example, aluminum) and a spaced-apart second radiating element 114, also made of a conductive material such as a metal. The first radiating element 112 and the second radiating element 114 are substantially in alignment with each other, so that both tend to be disposed along a common axis 116. While the first radiating element is ideally coaxial with the second radiating element, they may be off coaxial without departing from the scope of the invention. However, performance of the antenna may degrade as the radiating elements get further off coaxial. Typically, the height of the antenna unit 110 need only be about 1.5% of the wavelength. Thus, the invention allows for relatively compact antenna designs.

In the embodiment of FIG. 1, the first radiating element 112 and the second radiating element 114 each comprise a cylinder. As will be shown below, the radiating elements could include conic sections as well, or many other shapes (or combinations thereof), as will be readily understood by those of skill in the art of antenna design.

The phasing and matching network 120 is in electrical communication with the first radiating element 112, the second radiating element 114 and the radio device 102. The phasing and matching network 120 aligns the relative phase between the current and the voltage of the radio frequency power signal so that the H-field component of the corresponding electromagnetic signal is nominally in time phase with the E-field component. The wires connecting the phasing and matching network 120 to the antenna unit 110 should be as short as practical so as to minimize transmission line effects. Because the E field and the H field are substantially in phase with each other near antenna unit 110 a Poynting vector is created almost immediately near the antenna unit 110.

In one illustrative embodiment, the phasing and matching network 120 includes a first inductor 122 that electrically couples a first terminal 104 of the radio device 102 to the first radiating element 112 and a first capacitor 124 electrically couples a second terminal 106 of the radio device 102 to the first radiating element 112. A second inductor 126 electrically couples the second terminal 106 of the radio device 102 to the second radiating element 114 and a second capacitor 128 is electrically in parallel with the second inductor 126. While one example of a reactive element circuit configuration embodying a phasing and matching network 120 is shown in FIG. 1, it is understood that many other circuit configurations may be used without departing from the scope of the invention.

An important feature of the phasing and matching network 120 is that it performs the step of aligning the relative phase between the current and the voltage of the radio frequency power signal so that the H-field component of the corresponding electromagnetic signal is nominally in time phase with the E-field component. As will be readily appreciated by those of skill in the art, the specific circuit elements and configuration used are unimportant so long as the result is proper performance of the phase alignment function.

In one specific example used to communicate with a signal having an operating frequency of 7 MHz with a bandwidth of 500 KHz, the first inductor 122 has an inductance of 17 $\mu$H, the first capacitor 124 has a capacitance of 30 pf, the second inductor has an inductance of 19 $\mu$H and the second capacitor has a capacitance of 42 pf. The phasing and matching network 120 is connected to the transmitter/receiver 102 by a coaxial cable (not shown). The first radiating element 112 and the second radiating element 114 are each aluminum cylinders having a height of 12 in. and a diameter of 4.5 in. and are spaced apart by 4.5 in. It was observed that this embodiment resulted in a system Q of(+/−3 dB bandwidth) of approximately 7.5.

Figure 2:
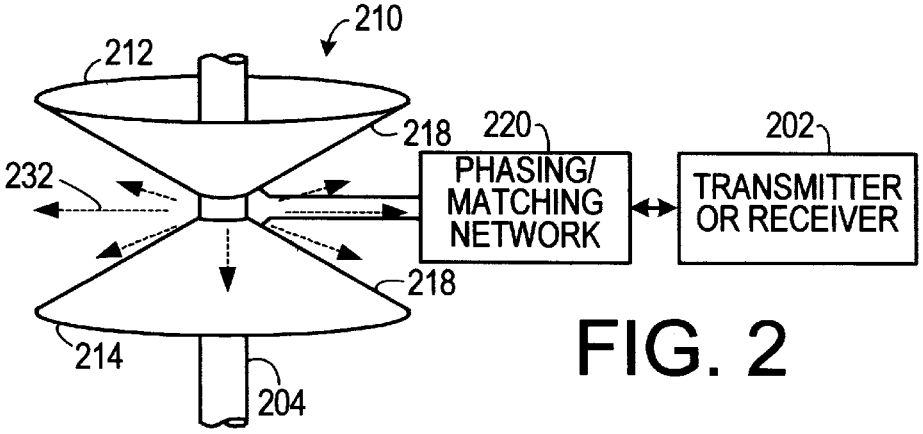
FIG. 2 is a schematic diagram of a second illustrative embodiment of the invention.

In one embodiment of the antenna unit 210, as shown in FIG. 2, the first radiating element 212 and the second radiating element 214 each comprise conic sections that are supported by an axial non-conducting pipe (such as a PVC pipe). In this embodiment, the electromagnetic radiation 232 forms between the radiating elements 212 and 214 and is directed radially away from the antenna unit 210. The angle of the conic sections of the radiating elements 212 and 214 depends on many factors and can vary depending on the specific application. The angle between the operative surfaces 218 of the radiating elements 212 and 214 can be selected in a range from nearly zero degrees (forming extremely wide diameter cones) to 180° (forming coaxial cylinders, as shown in FIG. 1). Theoretically, if the operative surfaces are exactly parallel (such that they form parallel disks) then the electromagnetic radiation would not escape the disks.

In one specific embodiment, used to transmit or receive a radiation having a wave length of 934 feet at 1 MHz, the wide ends of the conic sections have a diameter of 14.49 feet and a height of 1.95 feet each, with a 30° angle between the operative surfaces 218. In this embodiment, the radiating elements 212 and 214 are supported by a coaxial 8 in. PVC pipe.

Figure 3:
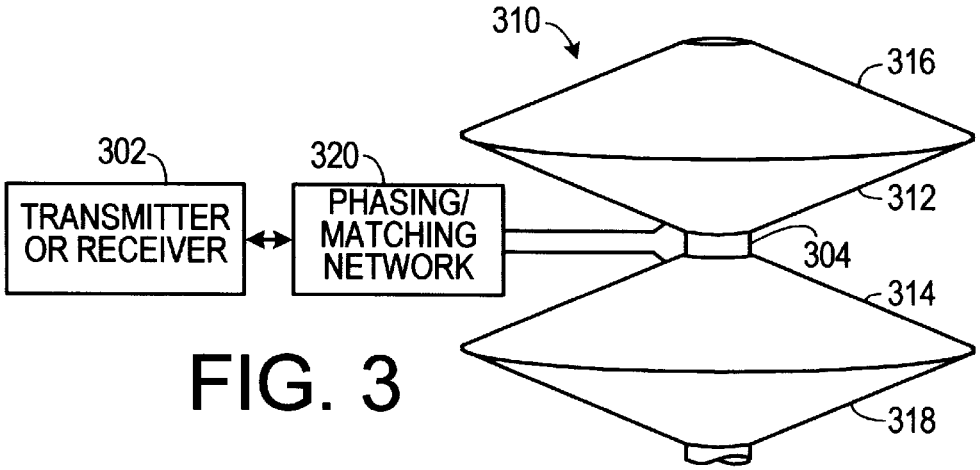
FIG. 3 is a schematic diagram of the embodiment of FIG. 2 with covers added to the conic sections of the antenna.

As shown in FIG. 3, a first cover 316 may be added to the first radiating element 312 to keep rain, snow and bird nests, etc., out of the first radiating element 312. Similarly, a second cover 318 may be added to the second radiating element 314 to keep out similar such debris.

Figure 4:
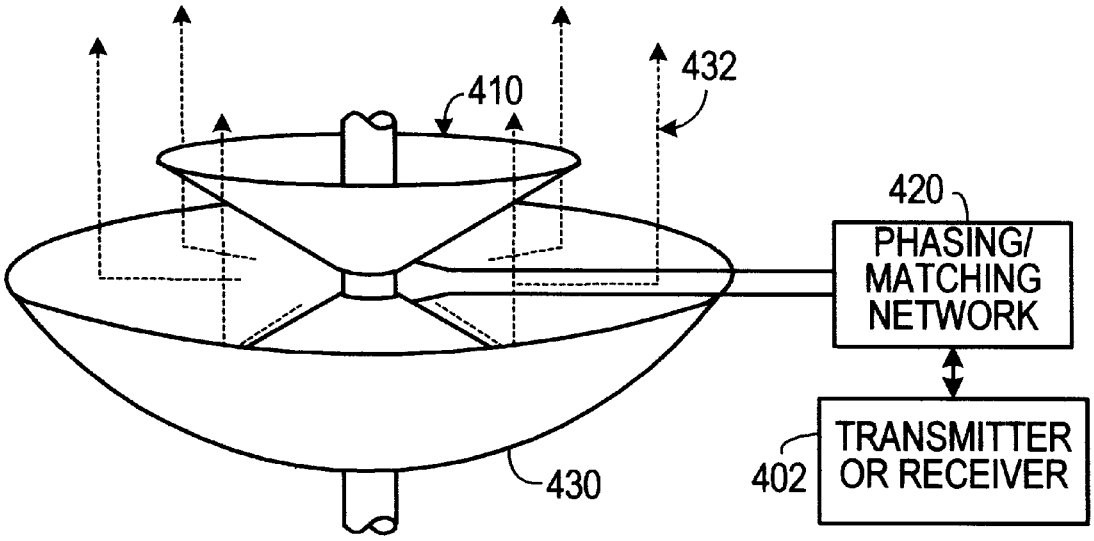
FIG. 4 is a schematic diagram of a third illustrative embodiment of the invention adapted for generating a substantially directed beam of radiation.

As shown in FIG. 4, the antenna unit 410 may be placed in a reflective shape 430. Such an embodiment could be used in directing a beam 432 at a selected object. Such a shape 430 could be a parabolic reflector or some other shape (such as an inverted cone). When the beam is directed upward by the reflective shape 430 so that the beam 432 follows a near vertical profile, the embodiment of FIG. 4 could be used in near vertical incidence communications.

One advantage of the antenna system of the invention is that it responds only to true radiated signals, not to electrical noise. Therefore, the invention increases the signal-to-noise ratio compared to prior art systems.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. An antenna system for transmitting and receiving, in association with a radio device, electromagnetic radiation having an E-field component and an H-field component, the electromagnetic radiation corresponding to a radio frequency power signal having a current and a voltage at a radio frequency, the current and the voltage each having a phase, the antenna system comprising:

a. a first radiating element comprising a conductive material;

b. a second radiating element comprising a conductive material, the second radiating element spaced apart from and in alignment with the first radiating element; and c. a phasing and matching network, in electrical communication with the first radiating element, the second radiating element and the radio device, that aligns the relative phase between the current and the voltage of the radio frequency power signal so that the H-field component of the corresponding electromagnetic signal is nominally in time phase with the E-field component, the phasing and matching network including:

i. a first reactive element of a first type that electrically couples a first terminal of the radio device to the first radiating element;

ii. a second reactive element of a second type that electrically couples a second terminal of the radio device to the first radiating element;

iii. a third reactive element of the first type that electrically couples the second terminal of the radio device to the second radiating element; and iv. a fourth reactive element of the second type that is electrically in parallel with the third reactive element.

2. The antenna system of claim 1, wherein the radio device is a transmitter.

3. The antenna system of claim 1, wherein the radio device is a receiver.

4. The antenna system of claim 1, wherein the first type of reactive element comprises an inductor and wherein the second type of reactive element comprises a capacitor.

5. The antenna system of claim 1, wherein the first type of reactive element comprises a capacitor and wherein the second type of reactive element comprises an inductor.

6. The antenna system of claim 1, wherein the first radiating element and the second radiating element each comprise a cylinder.

7. The antenna system of claim 1, wherein the first radiating element and the second radiating element each comprise a conic section.

8. The antenna system of claim 7, wherein each conic section includes a narrow end and a wide end, the narrow end of the conic section of the first radiating element being disposed adjacent to the narrow end of the conic section of the second radiating element.

9. The antenna system of claim 7, wherein each conic section includes a narrow end and a wide end, the antenna system further comprising a first cover disposed so as to cover the wide end of the conic section comprising the first radiating element and a second cover disposed so as to cover the wide end of the conic section comprising the second radiating element.

10. The antenna system of claim 1, further comprising a reflective shape disposed around the first radiating element and the second radiating element so as to reflect a portion of any electromagnetic radiation emanating from between the first radiating element and the second radiating element along a preselected direction.

11. A method of transmitting and receiving, in association with a radio device, electromagnetic radiation having an E-field component and an H-field component, the electromagnetic radiation corresponding to a radio frequency power signal having a current and a voltage at a radio frequency, the current and the voltage each having a phase, comprising the step of aligning the relative phase between current and the voltage of the radio frequency power signal so that the H-field component of the corresponding electromagnetic signal is nominally in time phase with the E-field component, whereby the aligning step includes the following steps:

i. coupling a first terminal of the radio device to a first radiating element with a first reactive element of a first type;

ii. coupling a second terminal of the radio device to the first radiating element with a second reactive element of a second type;

iii. coupling a second terminal of the radio device to a second radiating element with a third reactive element of the first type; and iv. placing a fourth reactive element of the second type electrically in parallel with the third reactive element.

12. The method of claim 11, further comprising the step of directing the radio frequency, power signal from a transmitter to an antenna having said first radiating element and said second radiating element, thereby generating the electromagnetic radiation between the first radiating element and the second radiating element.

13. The method of claim 12, further comprising the step of disposing the first radiating element so as to be in alignment with the second radiating element.

14. The method of claim 12, further comprising disposing the first radiating element and the second radiating element in a reflective shape so as to direct an electromagnetic beam substantially along a selected direction.

15. The method of claim 14, further comprising the step of choosing a reflective shape so that the beam follows a near vertical incidence profile.

16. The method of claim 11, further comprising the step of directing the radio frequency power signal from an antenna having said first radiating element and said second radiating element to a receiver.

17. The method of claim 16, further comprising the step of disposing the first radiating element so as to be in alignment with the second radiating element.

18. The method of claim 16, further comprising disposing the first radiating element and the second radiating element in a reflective shape so as to direct an electromagnetic beam substantially along a selected direction.

19. The method of claim 18, further comprising the step of choosing a reflective shape so that the beam follows a near vertical incidence profile.

* * * * *